United States Patent [19]

Wake et al.

[11] 4,157,081

[45] Jun. 5, 1979

[54] RECIRCULATED EXHAUST GAS CONTROL DEVICE FOR USE IN A DIESEL ENGINE

[75] Inventors: Junichi Wake, Yono; Hiroshi Matsuda, Sakado, both of Japan

[73] Assignee: Nissan Diesel Motor Co., Ltd., Ageo, Japan

[21] Appl. No.: 870,485

[22] Filed: Jan. 18, 1978

[30] Foreign Application Priority Data

Jan. 18, 1977 [JP] Japan ..... 52-003569

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,135,253 | 6/1964 | Muhlberg | 123/119 A |
| 3,906,909 | 9/1975 | Garcea | 123/119 A |
| 3,915,134 | 10/1975 | Young et al. | 123/119 A |
| 3,916,857 | 11/1975 | Naito | 123/119 A |
| 4,020,809 | 3/1977 | Kern | 123/119 A |

FOREIGN PATENT DOCUMENTS

| | | | |
|---|---|---|---|
| 2543804 | 4/1977 | Fed. Rep. of Germany | 123/119 A |

*Primary Examiner*—Wendell E. Burns

*Attorney, Agent, or Firm*—Birch, Stewart, Kolasch & Birch

[57] ABSTRACT

The present invention is directed to a to a diesel engine comprising a throttle valve disposed in an intake passage, which gradually opens in accordance with an increase in the level of the load of the engine. A recirculated exhaust gas conduit is also provided for recirculating a partial amount of the exhaust gas into the intake passage located at the downstream side side of the throttle valve so that the exhaust gas recirculation ratio could be reduced in accordance with an increase in the level of the engine load. In addition a solenoid valve is disposed in the recirculated exhaust gas conduit for stopping the recirculating of the exhaust gas when the engine is being operated under a heavy load.

13 Claims, 3 Drawing Figures

RECIRCULATED EXHAUST GAS CONTROL DEVICE FOR USE IN A DIESEL ENGINE

DESCRIPTION OF THE INVENTION

The present invention relates to diesel engines and particularly pertains to a recirculated exhaust gas control device capable of appropriately controlling the amount of recirculated exhaust gas in accordance with change in the operating condition of engines.

As a means of reducing the amount of harmful NOx components in the exhaust gas, there has been available a conventional prior art device which suppresses the maximum temperature of the combustion gas so as to reduce the amount of the harmful NOx components produced in the combustion process.

However, in diesel engines, if the exhaust gas recirculation ratio (a ratio of an amount of the recirculated exhaust gas to the sum of amount of the introduced air and the recirculated exhaust gas) is maintained at a constant valve, there occurs a problem in that the output power of an engine is reduced when the engine is operating at a high speed under a heavy load.

The object of the present invention is to provide a recirculated exhaust gas control device capable of appropriately controlling the amount of recirculated exhaust gas in accordance with any changes in the engine speed and the level of the engine load.

According to the present invention, there is provided a diesel engine having an intake passage and an exhaust passage, comprising: a throttle valve disposed in the intake passage that gradually opens in accordance with an increase in the level of the engine load; a recirculated exhaust gas passage communicating the exhaust passage with the intake passage and having an outlet which opens into the intake passage at a position located at the downstream side of the throttle valve for gradually reducing the exhaust gas recirculation ratio in accordance with an increase in the level of the engine load; detecting means for detecting the level of the engine load to provide an output signal indicating that the engine is operating under a heavy load, and a valve means disposed in the said recirculated exhaust gas passage for stopping the recirculating operation of the exhaust gas in response to the said output signal when the engine is operating under a heavy load.

Details about the present invention will be understood fully from the following description of preferred embodiments, together with the references to the drawings attached hereto.

DESCRIPTION OF PREFERRED EMBODIMENTS

Figure 1:
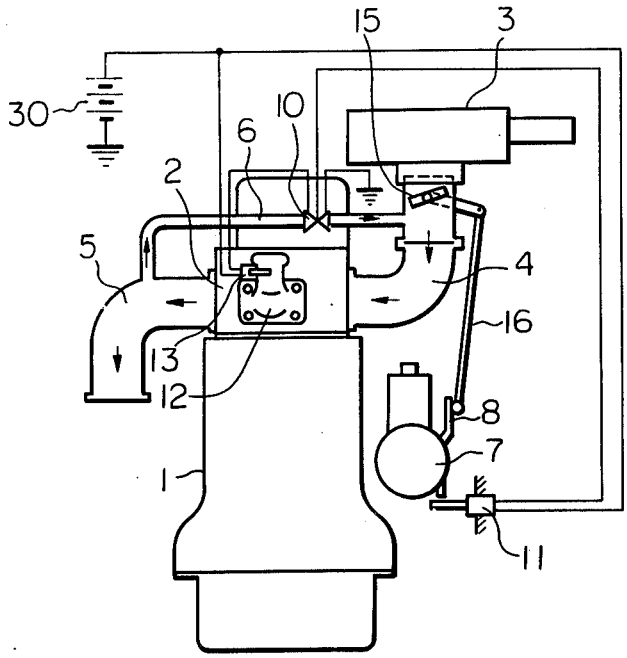
FIG. 1 is the schematic view of the embodiment of an engine that accords to the present invention.

Referring to FIG. 1, 1 designates an engine body, 2 a cylinder head, 3 an air cleaner, 4 an intake manifold, 5 an exhaust manifold, and 6 a recirculated exhaust gas conduit communicating the exhaust manifold 5 with the intake passage 14 for recirculating a part of the exhaust gas into the intake manifold 4. Reference numeral 7 designates a fuel injection pump, and 8 illustrates a control lever for controlling the amount of fuel discharged from the pump 7 in response to the depression of an acceleration pedal (not shown).

A solenoid valve 10 is disposed in the recirculated exhaust gas conduit 6 and also connected to a power source 30 via a limit switch 11 so that the solenoid valve 10 is closed in concert with the output signal of the limit switch 11 when the engine is operating under a heavy load. That is, the limit switch 11 is so arranged as to come into engagement with the control lever 8 of the fuel injection pump 7, therefore, the limit switch 11 is turned to the ON condition when the engine load is increased beyond the predetermined level (for example, 75 percent relative to the full load). When the limit switch 11 is turned to the ON condition, the solenoid valve 10 is energized and closed. Consequently, when the engine load is increased beyond the predetermined level above-mentioned, the recirculating operation of the exhaust gas remains stopped.

On the other hand, a thermal switch 13 detecting the temperature of an engine-cooling water is disposed in a cooling water pipe 12, and the solenoid valve 10 is connected to the power source 30 via the thermal switch 13 so that the solenoid valve 10 is closed in response to the thermal switch 13 when the temperature of the cooling water tends to be lower than the predetermined level. As shown in FIG. 1, the solenoid valve 10 is connected to the power source 30 via the limit switch 11 and the thermal switch 13 which is arranged is parallel and, as a result, the solenoid valve 10 is closed at the time of the engine warm-up or when the engine is operating under a heavy load.

In addition, a throttle valve 15 is arranged in the intake passage 14, being positioned at the upstream of the outlet opening of the recirculated exhaust gas conduit 6. This throttle valve 15 is mechanically connected to the control lever 8 of the fuel injection pump 7 so that the opening degree of the throttle valve 15 is gradually increased as the level of the engine load is increased.

Figure 2:
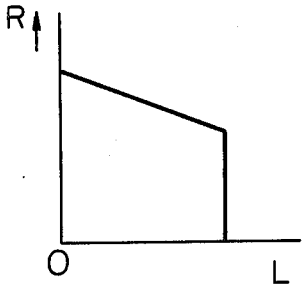
FIG. 2 is the graphic showing of the relationship that exists between the exhaust gas recirculation ratio and the load of engine.

In operation, when an engine is working under a light load, since the opening degree of the throttle valve 15 is small, a great vacuum is produced in the intake passage 14. Consequently, at this time, since the pressure difference between the vacuum in the intake passage 14 and that of the exhaust manifold 5 is great, a large amount of the exhaust gas is recirculated into the intake manifold 4. On the other hand, since the vacuum level in the intake passage 14 is reduced as the opening degree of the throttle valve 15 is increased, the pressure difference between the vacuum in the intake passage 14 and that of the exhaust manifold 5 is lessened as the level of the engine load is increased. Consequently, the exhaust gas recirculation ratio is reduced as the level of the engine load is increased. As mentioned previously, when the engine load is increased beyond the predetermined level, the limit switch 11 is turned to the ON condition. At this time, therefore, the solenoid valve 10 is closed and, as a result, the recirculating operation of the exhaust gas remains stopped. FIG. 2 shows a graphic illustration of the relationship that exists between the exhaust gas recirculation ratio and the load in the diesel engine according to the present invention. In FIG. 2, the ordinate indicates exhaust gas recirculation ratio R, and the abscissa indicates load L.

As mentioned previously, the thermal switch 13 is in the ON condition at the time of warm-up that ensues immediately after the engine is started. Consequently, at this time, the solenoid valve 10 is closed and, as a result, the recirculating operation of the exhaust gas remains stopped. This is because, if such a recirculating operation is carried out at the time of warm-up, the complete combustion cannot be obtained. Thus, it follows that there occurs a problem in that the rotating speed of the engine is reduced and, at the same time, the exhaust gas gives off an offensive smell.

In order to detect that an engine is being operated under a heavy load, a switch for detecting the depression of the acceleration pedal may be used instead of using the limit switch 11. In addition, with a view to detect that an engine is operating under a warm-up condition, the said switch for detecting the temperature or pressure of the exhaust gas may be used instead of using the thermal switch 13.

Figure 3:
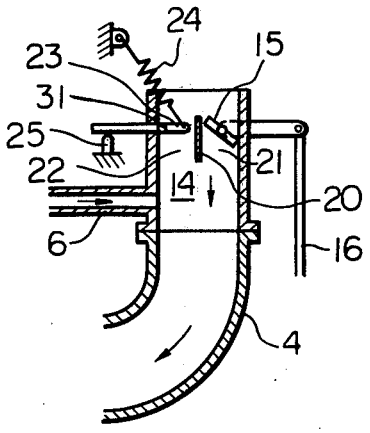
FIG. 3 is a cross-sectional side-view of an alternative embodiment according to the present invention.

FIG. 3 shows an alternative embodiment according to the present invention. Referring to FIG. 3, a partition 20 is places in the intake passage 14 at a position upstream of the outlet opening of the recirculated exhaust gas conduit 6. Thus, the intake passage 14 is divided into a main passage 21 and an auxiliary passage 22 by means of the partition 20 mentioned above. The throttle valve 15 is arranged in the main passage 21 and this is gradually opened as the level of the engine load is increased in the same manner as described with reference to FIG. 1. On the other hand, a normally closed type second throttle valve 23 is disposed in the auxiliary passage 22 and is normally positioned at a place wherein the throttle valve 23 abuts against a stop 25 by the spring force of a tension spring 24. However, when the vacuum level in the intake passage 14 is increased beyond a predetermined level, the throttle valve 23 rotates about a pivot 31 to gradually open the auxiliary passage 22 in accordance with an increase in the vacuum level in the intake passage 14.

In operation, when the engine is operating at a relatively low speed, the spring force of the tension spring 24, which causes rotation of the throttle valve 23 in the counter-clockwise direction is superior to the force, causing rotation of the throttle valve 23 in the clock wise direction which is caused by the pressure difference between the vacuums produced in the upstream and downstream sides of the throttle valve 23. As a result of this, since the second throttle valve 23 is not opened, the auxiliary passage 22 remains closed. Therefore, the entire air flows into the intake manifold 4 through the main passage 21. In this case, since the entire air is throttled by the throttle valve 15, the vacuum level in the intake manifold 4 is great. Consequently, when the engine is operating at a relatively low speed, the exhaust gas recirculation ratio is large. On the other hand, when the engine is operating at a high speed, a great vacuum is created in the intake passage 14. At this time, if the vacuum level is increased beyond the predetermined great level, the above-mentioned force causing the throttle valve 23 to rotate in the clockwise direction becomes superior to the spring force of the tension spring 24, which causes rotation of the throttle valve 23 in the counter-clockwise direction. As a result of this, the second throttle valve 23 rotates in the clockwise direction to open the auxiliary passage 22. Consequently, at this time, the air flows into the intake manifold 4 through the main passage 21 and the auxiliary passage 22. Thus, when the engine is operating at a high speed, the increase in the vacuum level in the intake manifold 4 is suppressed and, accordingly, the vacuum level is restricted up to an approximately constant level. At the same time, the throttling operation of air is relaxed. As a result of this, it is possible to stave off the problem that an undue increase in the vacuum level in the intake manifold 4 adversely affects the operation of the engine. In addition, it is possible to reduce the exhaust gas recirculation ratio when the engine is operating at a high speed. It should be understood from FIG. 3 that the throttle valve 15 is gradually opened as the level of the engine load is increased. Consequently, in the embodiment shown in FIG. 3, the exhaust gas recirculation ratio is controlled in accordance with the changes in the engine speed and the load of the engine.

According to the present invention, the exhaust gas recirculation ratio is reduced as the level of the engine load is increased and, the recirculating operation of the exhaust gas remains stopped when the engine is operating under a heavy load. As a result of this, the reduction of the engine output power can be prevented while maintaining well and enough the satisfactory purifying efficiency of the exhaust gas. In addition, it is possible to improve the drivability of a vehicle and also prevent the smoke that may arise when the exhaust gas is to be discharged into the atmosphere.

Furthermore, since the recirculating operation of the exhaust gas remains stopped at the time of the engine warm-up, a good combustion performance could be secured at the time of the warm-up.

In addition, when the engine is operating at a high speed, the throttling operation of the introduced air is relaxed and, accordingly, the exhaust gas recirculation ratio is reduced to that extent. As a result of this, it is possible to preclude a problem from happening in that an extraordinary increase in the vacuum level in the intake passage affects the operation of an engine and, thus, the life time of an engine can be improved

What is claimed is: using the control device according to the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

1. A diesel engine having a intake passage and an exhaust passage, comprising:

a throttle valve disposed in the intake passage which gradually opens, in accordance with an increase in level of the engine load;

a recirculated exhaust gas passage communicating the exhaust passage with the intake passage and having an outlet which opens into the intake passage at a position located downstream of said throttle valve for gradually reducing the exhaust gas recirculation ratio in accordance with an increase in a level of the engine load;

a detecting means for checking the level of the engine load to provide an output signal indicating that the engine is operating under a heavy load, and a valve means disposed in said recirculated exhaust gas passage for stopping the recirculating operation of the exhaust gas in response to said output signal when the engine is operating under a heavy load.

2. A diesel engine as claimed in claim 1, wherein said engine comprises a fuel injection control means having a movable member controlling the amount of fuel fed into the engine said throttle valve being operationally connected to said movable member.

3. A diesel engine as claimed in claim 2, wherein said movable member comprises a control lever of a fuel injection pump.

4. A diesel engine as claimed in claim 2, wherein said valve means comprises a solenoid valve and said detecting means comprises a limit switch cooperating closely with said movable member.

5. A diesel engine as claimed in claim 1, wherein said engine further comprises a second detecting means for checking the engine temperature and for actuating said valve means to stop the recirculating operation of the exhaust gas when the engine temperature is lower than a predetermined level.

6. A diesel engine as claimed in claim 5, wherein said valve means comprises a solenoid valve and said second detecting means comprises a thermal switch for detecting a coolant of the engine.

7. A diesel engine as claimed in claim 1, wherein the intake passage located upstream of the outlet of said recirculated exhaust gas passage is divided into a first passage and a second passage, said throttle valve being disposed in said first passage and a second throttle valve which opens in accordance with the changes in the level of the vacuum produced in the intake passage being disposed in said second passage.

8. A diesel engine as claimed in claim 7, wherein said second throttle valve is normally biased in the closed position by means of a spring and opened when the level of vacuum in the intake passage is increased beyond a predetermined level.

9. A diesel engine as claimed in claim 7, wherein said engine comprises a fuel injection control means having a movable member controlling the amount of the fuel fed into the engine said throttle valve disposed in said first passage being operationally connected to said movable member.

10. A diesel engine as claimed in claim 9, wherein said movable member comprises a control lever of a fuel injection pump.

11. A diesel engine as claimed in claim 9, wherein said valve means comprises an electromagnetic valve and said detecting means comprises a limit switch cooperating with said movable member.

12. A diesel engine as claimed in claim 7, wherein said engine further comprises a second detecting means for examining the engine temperature and for actuating said valve means to stop the recirculating operation of the exhaust gas when the engine temperature is lower than a predetermined level.

13. A diesel engine as claimed in claim 12, wherein said valve means comprises an electromagnetic valve and said second detecting means comprises a thermal switch for detecting a coolant of the engine.

* * * * *